US011851619B2

(12) United States Patent
Gates et al.

(10) Patent No.: US 11,851,619 B2
(45) Date of Patent: Dec. 26, 2023

(54) SEPARATION OF VISCOUS OILS INTO COMPONENTS

(71) Applicant: SOLIDEUM INC., Calgary (CA)

(72) Inventors: Ian Donald Gates, Calgary (CA); Jingyi Wang, Calgary (CA)

(73) Assignees: Ian Donald Gates, Calgary (CA); Jingyi Wang, Calgary (CA)

( * ) Notice: Subject to any disclaimer, the term of this patent is extended or adjusted under 35 U.S.C. 154(b) by 102 days.

(21) Appl. No.: 17/637,231

(22) PCT Filed: Aug. 21, 2020

(86) PCT No.: PCT/CA2020/051150

§ 371 (c)(1),
(2) Date: Feb. 22, 2022

(87) PCT Pub. No.: WO2021/035343

PCT Pub. Date: Mar. 4, 2021

(65) Prior Publication Data

US 2022/0340823 A1 Oct. 27, 2022

Related U.S. Application Data

(60) Provisional application No. 62/891,135, filed on Aug. 23, 2019, provisional application No. 62/891,141, filed on Aug. 23, 2019.

(51) Int. Cl.

| | |
|---|---|
| ***C10G 31/06*** | (2006.01) |
| ***C10G 9/00*** | (2006.01) |
| ***C10G 9/18*** | (2006.01) |
| ***C10G 9/24*** | (2006.01) |
| ***C10G 9/36*** | (2006.01) |
| ***C10G 9/14*** | (2006.01) |

(52) U.S. Cl.
CPC ..... *C10G 31/06* (2013.01); *C10G 9/002* (2013.01); *C10G 9/14* (2013.01); *C10G 9/18* (2013.01); *C10G 9/24* (2013.01); *C10G 9/36* (2013.01); *C10G 2300/4006* (2013.01)

(58) Field of Classification Search
CPC ..... C10G 31/06; C10G 2300/4006; C10C 3/002; B01J 2219/00085; B01J 2219/00132; B01J 2219/00157
See application file for complete search history.

(56) References Cited

U.S. PATENT DOCUMENTS

| | | | | |
|---|---|---|---|---|
| 1,627,162 | A | 5/1927 | Egloff | |
| 1,802,531 | A * | 4/1931 | Prichard | C10G 9/06 196/99 |
| 2,604,084 | A | 7/1952 | Sherman | |
| 5,391,304 | A * | 2/1995 | Lantos | B01D 3/06 210/804 |
| 5,445,799 | A | 8/1995 | McCants | |
| 2006/0219544 | A1 * | 10/2006 | DeVore | C10B 7/04 201/32 |

FOREIGN PATENT DOCUMENTS

| | | | |
|---|---|---|---|
| WO | 2012000115 | A1 | 1/2012 |
| WO | 2014146129 | A2 | 9/2014 |

* cited by examiner

*Primary Examiner* — Randy Boyer
(74) *Attorney, Agent, or Firm* — Dickinson Wright PLLC

(57) ABSTRACT

The invention provides methods for treating a source oil phase consisting of heavy oil, bitumen, a mixture of heavy oil and bitumen, a mixture of solvent and heavy oil or bitumen or both. The method comprises: introducing the source oil phase to a heated lower section of a device to provide an interior source oil phase; heating the interior source oil phase so as to thermally separate a light oil phase component therefrom and provide a vaporized light oil; and condensing the vaporized light oil phase on one or more internal cooling fins housed within the upper section of the device, to provide a condensed light oil phase liquid, wherein the internal cooling fins are angled so as to direct the condensed light oil phase liquid downwardly to a light end collection system.

20 Claims, 9 Drawing Sheets

Heat can be supplied by electrical heat, steam, hot fluid, or induction heating

TOP
VIEW

FIG. 8

| Item | Value |
|---|---|
| Source oil phase | Athabasca bitumen, 10°API |
| Time of operation | 10 minutes residence time |
| Temperature of heated section | 300°C |
| Inert gas injection | Nitrogen at 22°C |
| Ambient temperature around device | 22°C |
| Light oil phase fraction from original oil | 45% |
| Residual heavy oil phase fraction from original oil | 55% |
| Light oil phase | 23°API<br>Viscosity < 5 cP (at 22°C) |
| Residual heavy oil phase | Semi-solid-like<br>Viscosity >5 million cP (at 22°C) |

FIG. 9

| Item | Value |
|---|---|
| Source oil phase | Lloydminster heavy oil, 12°API |
| Time of operation | 10 minutes residence time |
| Temperature of heated section | 300°C |
| Inert gas injection | Nitrogen at 22°C |
| Ambient temperature around device | 22°C |
| Light oil phase fraction from original oil | 55% |
| Residual heavy oil phase fraction from original oil | 45% |
| Light oil phase | 23°API<br>Viscosity < 5 cP (at 22°C) |
| Residual heavy oil phase | Semi-solid-like<br>Viscosity >5 million cP (at 22°C) |

SEPARATION OF VISCOUS OILS INTO COMPONENTS

CROSS-REFERENCE TO RELATED APPLICATIONS

This application is a U.S. National Stage of International Application No. PCT/CA2020/051150, filed on Aug. 21, 2020, which claims the benefit and priority of U.S. Patent Application No. 62/891,135, filed on Aug. 23, 2019, and U.S. Patent Application No. 62/891,141, filed on Aug. 23, 2019, the entire contents of which are incorporated herein by reference.

FIELD OF THE INVENTION

The invention is in the field of methods for separating light components from a oil from heavy oil components or for raising the flash point of an oil.

BACKGROUND OF THE INVENTION

Typically, petroleum substances of high viscosity and density are categorized into two divisions: "heavy oil" and "bitumen". Commonly, "heavy oil" is defined as a petroleum that has a mass density of between about 920 kg/m$^3$ (or an API gravity of about 26°) and 1,000 kg/m$^3$ (or an API gravity of about 10°). Bitumen, or extra heavy oil, is typically defined as that portion of petroleum that exists in the semi-solid or solid phase in natural deposits, with a mass density greater than about 1,000 kg/m$^3$ (or an API gravity of about 10° or lower) and a viscosity greater than 10,000 centipoise (cP or 10 Pa·s) measured at the original temperature of the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen or extra heavy oil herein include the continuum of such substances, and do not imply the existence of some fixed and universally recognized boundary between the two substances. In particular, the term "heavy oil" includes within its scope all "bitumen" including hydrocarbons that are present in semi-solid or solid form. Similarly, a "bituminous" material is one that includes a bitumen component, as that component is broadly defined.

In many heavy oil processing systems, heavy oil or bitumen is mixed with a lighter solvent to make it easier for processing e.g. separation from water or for transportation e.g. obtaining a petroleum liquid which can be easily transport in a pipeline. Often solvent, typically composed of paraffin or naphtha solvents, are mixed with viscous heavy oils or bitumen to enable easier separation from water when the heavy oil or bitumen is produced from the reservoir. In other systems, solvent is added to the heavy oil or bitumen so that the mixture of the oils can reach the specifications for oil that can be readily transported in pipelines. In its original state, heavy oil or bitumen is too viscous to be pumped in pipelines. For example, in some pipelines, the oil must have viscosity that is equal or lower than 250 or 350 cSt.

In other systems, the solvent is added to the bitumen as one component of the recovery process to extract the heavy oil or bitumen from the reservoir originally containing the oil. The in situ viscosity of the heavy oil or bitumen is too high for it to be produced under primary production technologies from the reservoir and thus, it is required that the viscosity of the heavy oil or bitumen is lowered to a value so that it can be produced by normal forces from the reservoir. Such forces include pressure drive as would be the case when a high pressure material is injected into the reservoir and fluids are produced from the reservoir. The pressure difference between the injection well(s) and the production well(s) leads to a pressure difference that can move fluids through the reservoir and produce them from the reservoir to the surface. Another force that can move reservoir fluids, including oil, are gravity drainage where a density difference between fluid phases in the reservoir are sufficient to drain liquid oil to a production well. Another example of a force is solution gas drive where exsolved gas expands and displaces reservoir fluids towards a production well. The addition of solvent to the reservoir and subsequent mixing of the solvent with the heavy oil or bitumen lowers the viscosity of the oil phase which then has a lower viscosity than that of the original heavy oil or bitumen which then enables production of the solvent-heavy oil/bitumen mixture to the surface due to its reduced viscosity.

Often solvents used in the processing or treatment of heavy oil or bitumen are obtained from natural gas condensates or petroleum distillates, or from light crude oils.

Many heavy oils and bitumen consist of not only viscous components such as asphaltenes but also lighter materials. These light ends are composed of saturate (alkane) and aromatic components and typically have viscosities lower than that of the asphaltenic component. Upon heating of heavy oil or bitumen, reactions occur that can break bonds in the heavy components of the heavy oil and bitumen leading to the generation of lighter materials such as saturate and aromatic components. These components, when mixed with the original heavy oil and bitumen, can lead to an upgraded oil product with lower viscosity than that of the original heavy oil or bitumen.

There is an ongoing need for improved methods that are both relatively efficient and simple to separate solvents from mixtures of solvents and heavy oil or bitumen.

There is also an ongoing need for improved methods that are both relatively efficient and simple for thermally cracking heavy oil or bitumen or mixtures of solvents and heavy oil or bitumen to yield a lighter low viscosity oil phase and a viscous heavy oil phase.

SUMMARY OF THE INVENTION

In one aspect of the invention, a method and apparatus are provided that take advantage of heating a heavy oil or bitumen or a mixture of solvent and heavy oil or bitumen, each option referred to as the source oil phase, to temperatures between 280 and 600° C. in a inert gas environment where oxidation is prevented. At these elevated temperatures, the lighter components in the source oil phase will boil off at the prevailing pressure and be vaporized within the apparatus. Furthermore, at elevated temperatures, the source oil phase within the apparatus will thermally crack (pyrolyze) with larger molecules breaking into smaller molecules. This increases the yield of a light oil phase which vaporizes within the apparatus.

The other product of the separation or reactions is a residual heavy oil phase.

The lighter components are generally composed of relatively low molecular weight alkanes (linear hydrocarbons up to C40 alkanes and potentially above) and aromatics (cyclic hydrocarbons up to C40 aromatics and potentially above).

The apparatus has both external and internal cooling surfaces that provide for condensation of the light components within the apparatus. The condensed light oil phase is directed to a collection lipped balcony within the apparatus and is removed from the apparatus.

The inert gas environment within the apparatus has no oxygen within it which prevents oxidation (combustion) of the oil components within the apparatus.

The remaining residual heavy oil phase that results from the separation of light end components from the source oil phase or from the reactive generation (thermal cracking/pyrolysis) of light end components from the source oil phase apparatus is collected from the bottom of the apparatus. The residual heavy oil phase can be a feedstock for asphalt or other carbon-based products.

Methods are accordingly provided for separating a source oil phase (heavy oil or bitumen or a mixture of solvent and heavy oil or bitumen or both) into a light end oil phase and a residual heavy oil phase by either evaporation of the lighter components from the source oil phase or reactive generation of light oil components by thermal cracking or pyrolysis or both.

The methods involve the use of heat transfer fins within the apparatus at the top part of the device to accelerate the condensation of the light end components within the device. Furthermore, external surfaces of the top part of the device can have external fins to enhance heat transfer to provide cooling to maximize the condensation of light end components. The temperature of the inert gas can be provided to the device at relatively cool conditions to accelerate condensation of the light end components in the device.

In alternative aspects, the operating temperatures (heating and cooling) and pressure of the unit can be altered to tune the yield of the light end product (the fractional amount of condensed light end oil phase produced) from the method.

In other alternative aspects, the operating temperatures (heating and cooling) and pressure of the unit can be adjusted to calibrate the density and properties of the residual heavy oil phase that results from the process.

Methods are accordingly provided for treating a source oil phase consisting of heavy oil, bitumen, a mixture of heavy oil and bitumen, a mixture of solvent and heavy oil or bitumen or both, comprising:

- Introducing the source oil phase to a heated section within the device;
- Heating the source oil phase so as to physically separate a light oil phase components from the source oil phase;
- Condensing the light oil phase by using internal cooling fins in the upper section of the device where the fins direct the condensed liquid to the light end collection system;
- Injecting a cool inert gas into the top of the device to help cool the upper section of the device which also helps to motivate the light oil phase product through the light end collection system; and
- Collecting the residual heavy oil phase from the device.

In alternative aspects, methods are provided wherein heating to the device is provided from any combination of electrical resistance heating, induction heating, heat tracing, and hot fluid heating either within a pipe or directly into the source oil phase.

In alternative aspects, methods are provided wherein the temperature of the heated section is between about 280 and 600° C. and preferably between about 350 and 550° C.

In alternative aspects, methods are provided wherein the cooling section is maintained at a temperature between about 20° C. and 200° C.

In alternative aspects, methods are provided wherein the internal cooling fins are cooled through heat conduction or by a cool fluid injection within the fins.

In alternative aspects, methods are provided wherein the cooling inert gas is composed of nitrogen, carbon monoxide, carbon dioxide, methane, ethane, propane, hydrogen, combustion flue gas, or mixtures thereof.

BRIEF DESCRIPTION OF THE DRAWINGS

FIG. 8 lists data from operation of the method for Athabasca bitumen.

FIG. 9 lists data from operation of the method for Lloydminster heavy oil.

DETAILED DESCRIPTION OF THE INVENTION

Methods are provided to separate a light oil phase and residual heavy oil phase from a source oil phase (either heavy oil, bitumen, or a mixture of solvent and heavy oil or bitumen or both) where an inert gas is introduced into the device that contains internal cooling fins that direct the condensed light end components to a collection system within the device.

Figure 1:
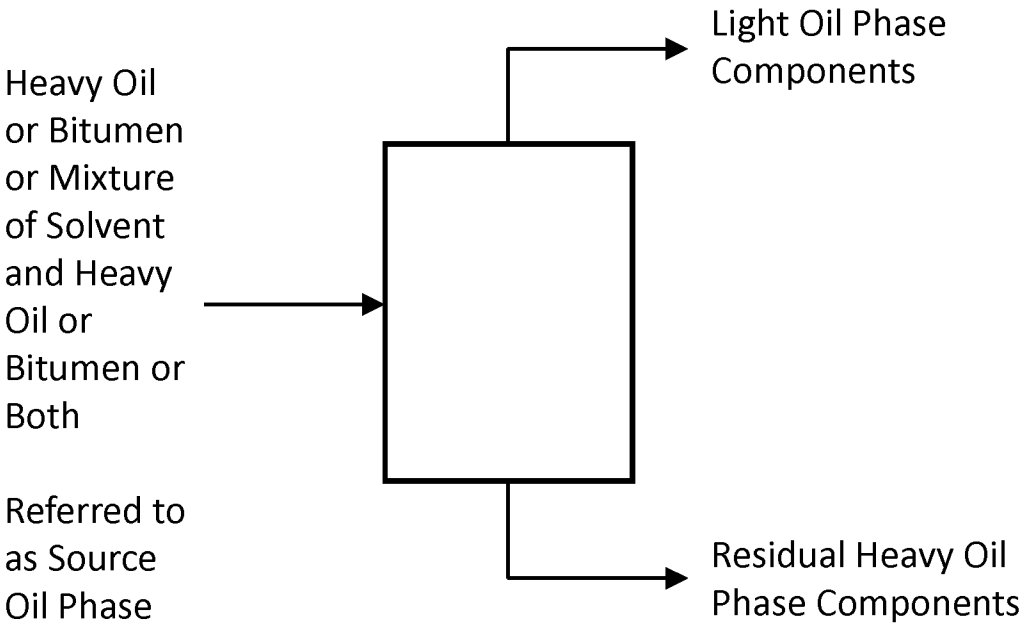
FIG. 1 is a diagram a general material flow diagram wherein a heavy oil or bitumen or a mixture of solvent and heavy oil or bitumen or both (the source oil phase) is fed to the device and a light oil phase and residual heavy oil phase are produced.

FIG. 1 displays one embodiment of the device. The source oil phase enters the device into the heated section of the device where the temperature is between 280 and 600° C. The heating to the bottom section of the device can be provided from a heated working fluid, e.g. hot flue gas, steam, or oil, electrical resistance heaters, or induction heaters. An hot inert gas 1 can be injected into the bottom of the device to aid in mixing of the heated oil and to help heat the oil.

In the device taught here, a relatively cool inert gas 2 is introduced to the top part of the device. This top part of the device contains internal cooling fins to help condense the light oil components that have been vaporized. The top part of the device can also have external cooling fins on its outer surface to help with heat transfer.

The inert gases 1 and 2 is preferentially any gas that is absent of oxygen. This includes nitrogen, flue gas, methane, carbon dioxide, flue gas, and mixtures thereof.

In some implementations, the inert gas introduced to the device is at lower temperature than the hot section of the device.

FIG. 1 displays a general material flow diagram of the method. In the method taught here, heavy oil or bitumen or both or a mixture of solvent and heavy oil or bitumen or both (source oil phase) enters the device and is converted to a light oil phase and a residual heavy oil phase.

Figure 2:
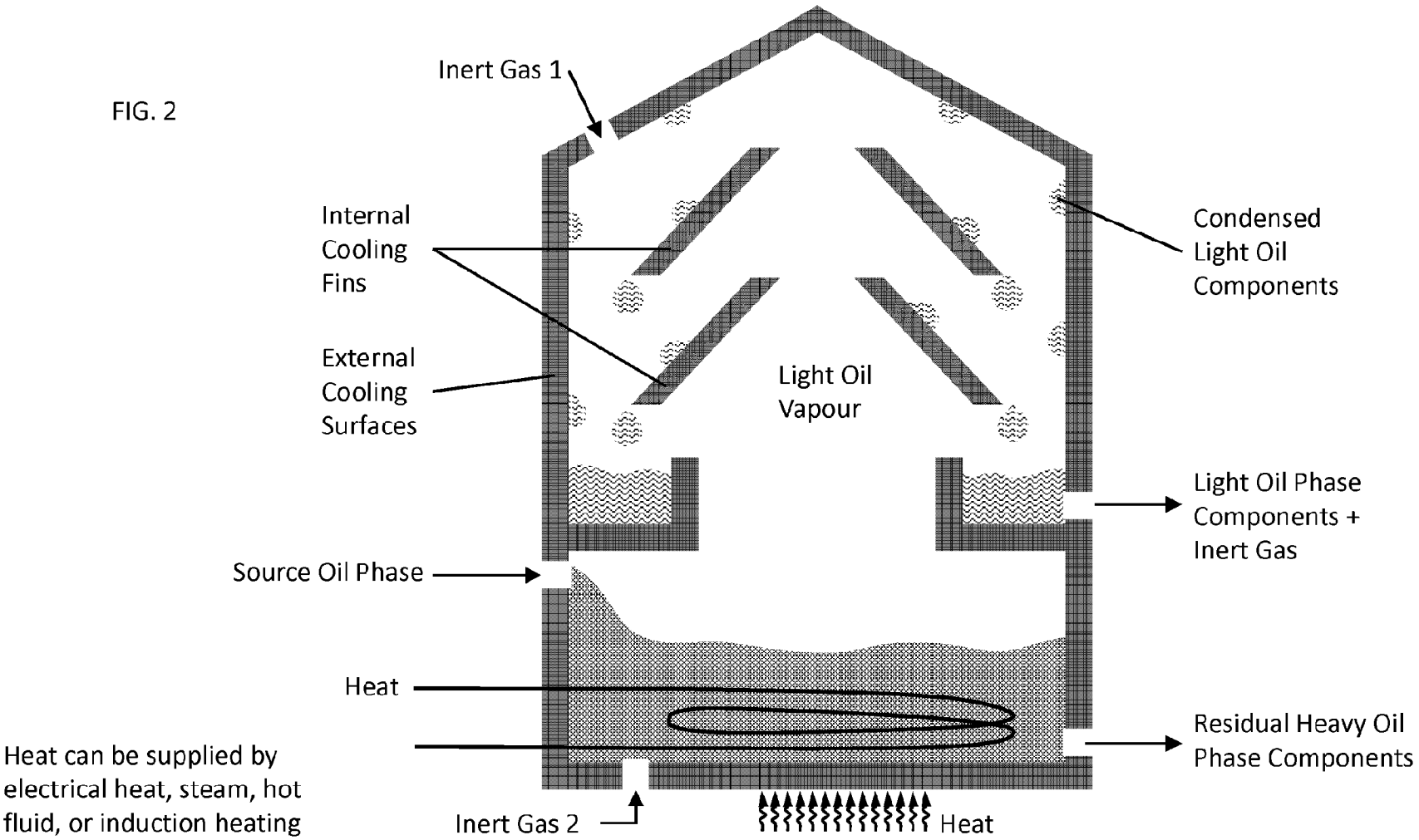
FIG. 2 is a diagram exemplifying one implementation of the methods described herein for treating a source oil phase and converting it into a light oil phase and a residual heavy oil phase.

FIG. 2 illustrates an implementation of the present methods for treating a source oil phase. In this method, the source oil phase flows into the lower section of the device which is heated to temperatures between 280 and 600° C. The heated oil generates vapors by two physical consequences. First, the light end components in the source oil phase are vaporized due to sufficient latent heat being supplied that boils off the light end components. Second, the source oil phase components, especially the larger, heavy molecules, are broken down by thermal cracking (pyrolysis) into light end components that then are boiled off from the liquid in the heated zone of the device.

The vaporized light end components rise into the upper section of the device where they encounter the internal cooling fins and external cooling surfaces as well as the cool inert gas that is introduced into the top of the cooling section. The light end components cool down in the top section and subsequently condense on the internal cooling funs and external cooling surfaces which then direct the condensed liquid to the collection pool from which the liquid light end components are removed from the device. The top section of the device is kept cooler than about 200° C. and preferably lower than 160° C.

The internal fins not only serve as internal cooling fins but also help to direct the hot vaporized light end components up the central part of the device. The vaporized light end components then condense on the internal fins and the top of the device and drain under gravity towards the outer parts of the top part of the device which then direct the liquid light end components to the light end collection system.

The flow of the inert gases 1 and 2 also helps to move the liquid light ends from the device through the exit to the liquid light end components collection system.

The heaters at the base of the device can consist of conductive heating through the device wall from electrical resistance heaters (e.g. heat tracing tape or lines), electrical induction heaters (with induction heating plates), injection of hot inert or flue gas (for example the product of combustion of a fuel) directly into the heated source oil, or steam-based heating where steam pipes are placed within the heated source oil, or heated fluid (for example hot oil or hot flue gas) heating where hot fluid pipes are placed within the heated source oil.

Figure 3:
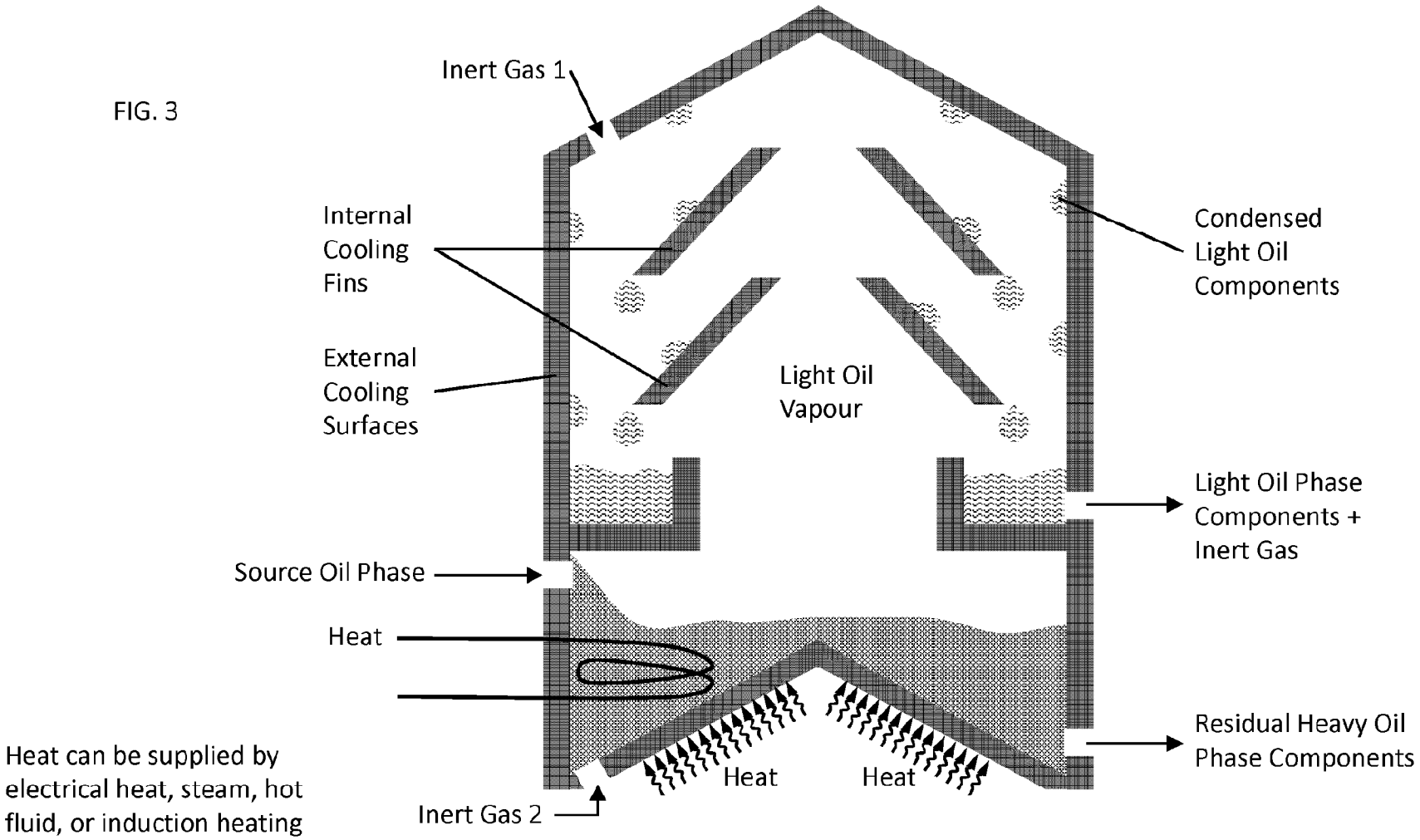
FIG. 3 is a diagram exemplifying another implementation of the methods described herein for treating a source oil phase and converting it into a light oil phase and a residual heavy oil phase.

FIG. 3 illustrates another implementation of the present methods for treating a source oil phase where the bottom of the device directs the source oil phase towards the outer edges of the device where external heaters may be present.

Figure 4:
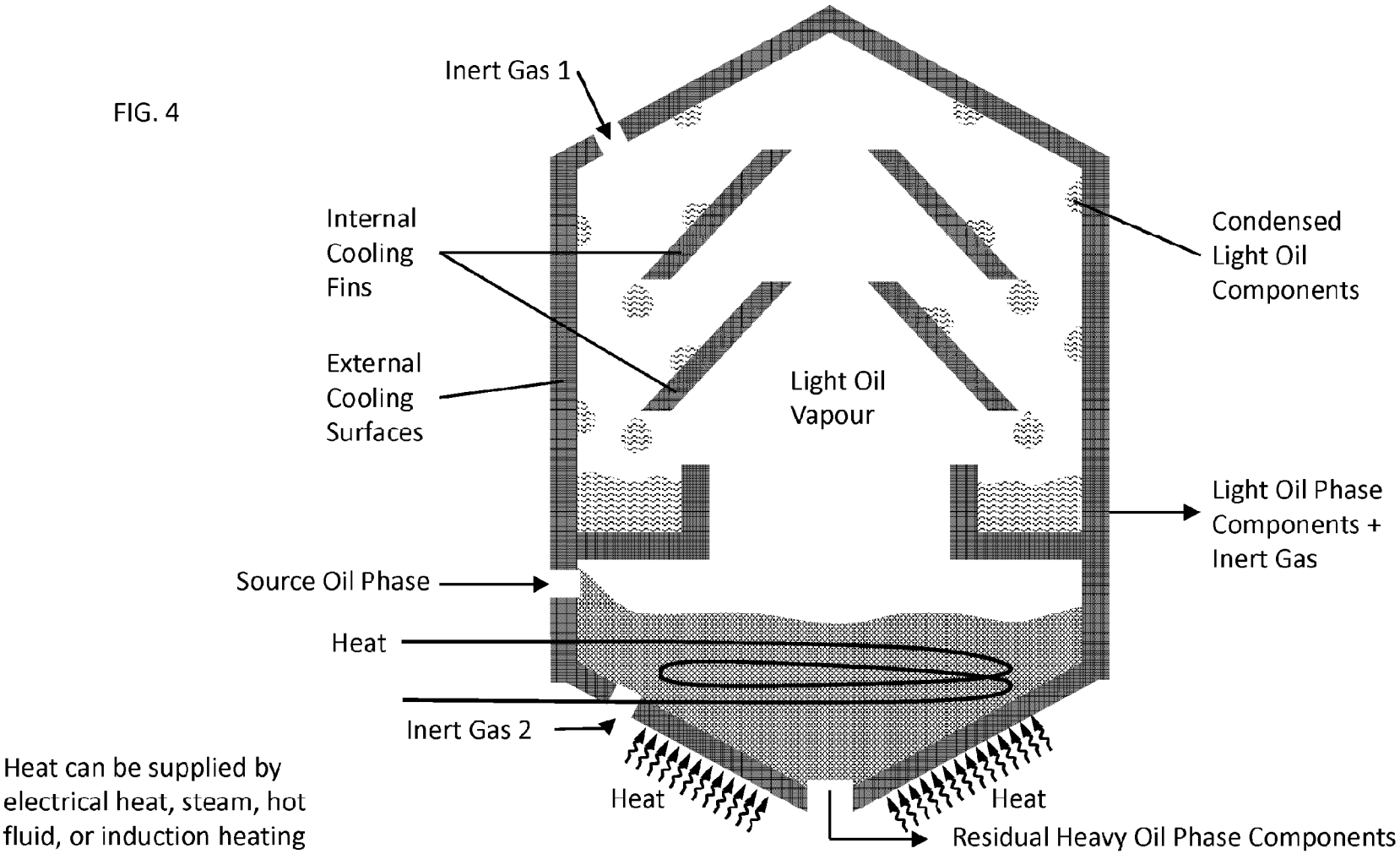
FIG. 4 is a diagram exemplifying another implementation of the methods described herein for treating a source oil phase and converting it into a light oil phase and a residual heavy oil phase.

FIG. 4 illustrates another implementation of the present methods for treating a source oil phase where the bottom of the device directs the source oil phase towards a central exit for the residual heavy oil phase. Since the density of the residual heavy oil phase is higher than that of the original source oil phase, the residual heavy oil phase descends to the lower part of the heated section and is then withdrawn from the device.

Figure 5:
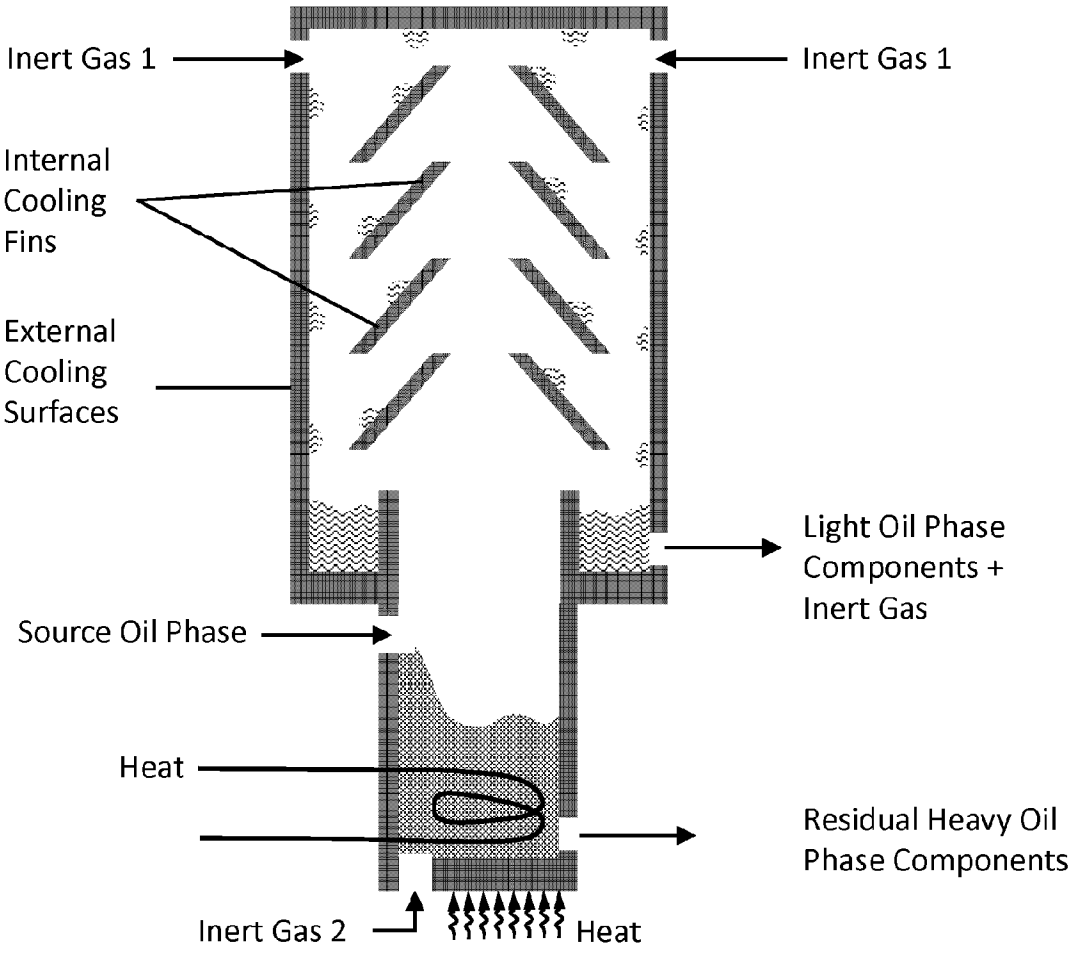
FIG. 5 is a diagram exemplifying another implementation of the methods described herein for treating a source oil phase and converting it into a light oil phase and a residual heavy oil phase.

FIG. 5 illustrates another exemplary embodiment of the present methods for treating a source oil phase where heated section where the source oil phase enters the device and collects in the heated lower section of the device. The inert gas 1 is injected at the top for cooling the top section as well as helping to move the light oil phase products from the device through the light oil collection system. The hot inert gas 2 is injected into the hot source oil phase at the base of the device to help heat the source oil phase and when it rises through the device also helps to move the light oil phase products from the device through the light oil collection system. The light end components condense in the upper section on the internal cooling fins as well as the external cooling surfaces.

The internal surfaces of the device, especially the lower heating section containing the heated source oil phase, can be coated with a oleicophobic substrate.

The inert gas injection may also contain hydrogen which can be used to produce greater amounts of the light oil phase product.

The residence time of the source oil phase in the device is to be of order of seconds to hours, preferably of the order of minutes to tens of minutes.

Figure 6:
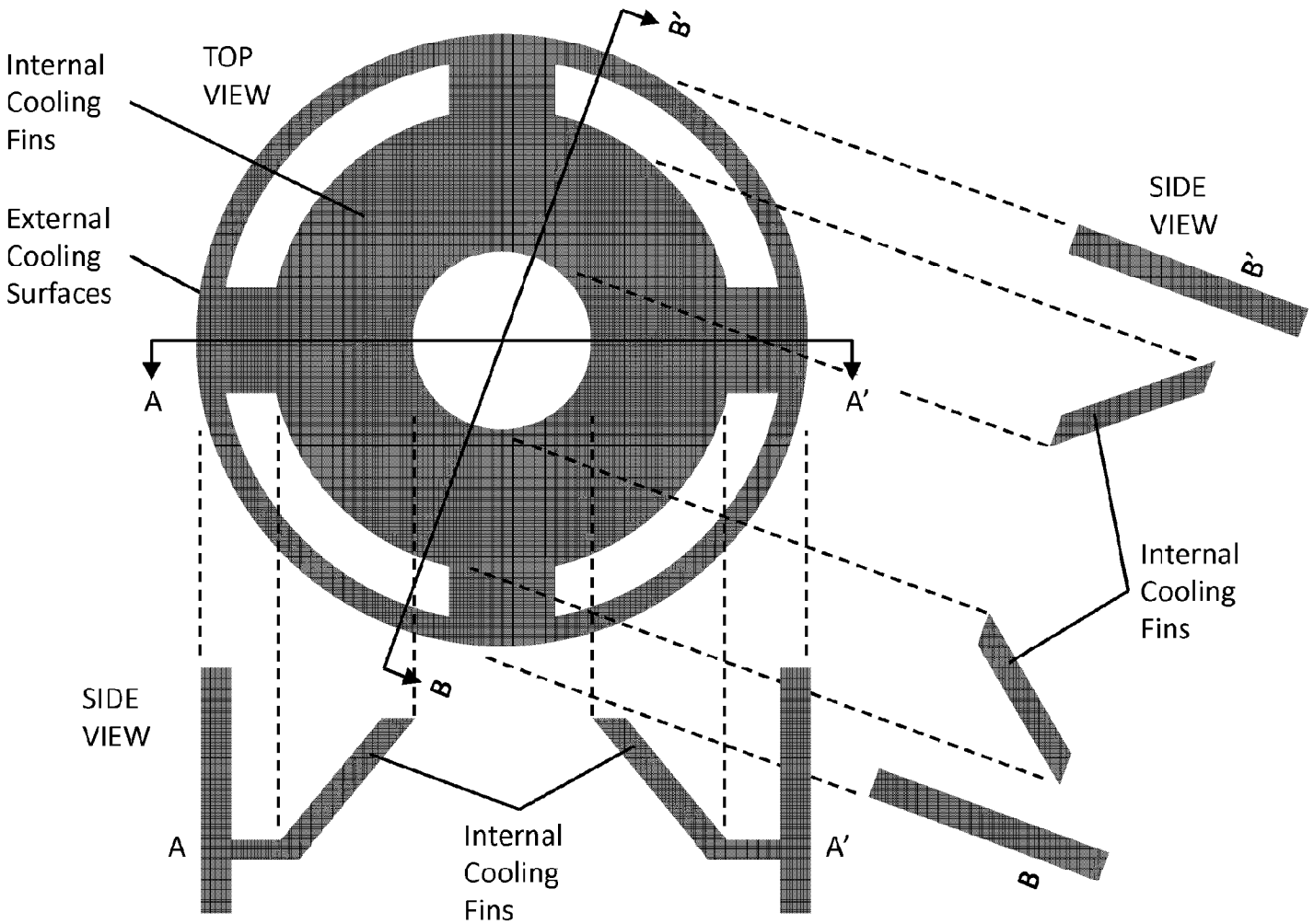
FIG. 6 is a diagram exemplifying the internal cooling fins within the device.

FIG. 6 displays more details on the internal cooling fins. The fins are connected to the external wall of the device so that the internal fins can enable heat transfer within the device. Cooling fluids can be circulated within the internal cooling fins to lower the temperature of the internal cooling fins.

Figure 7:
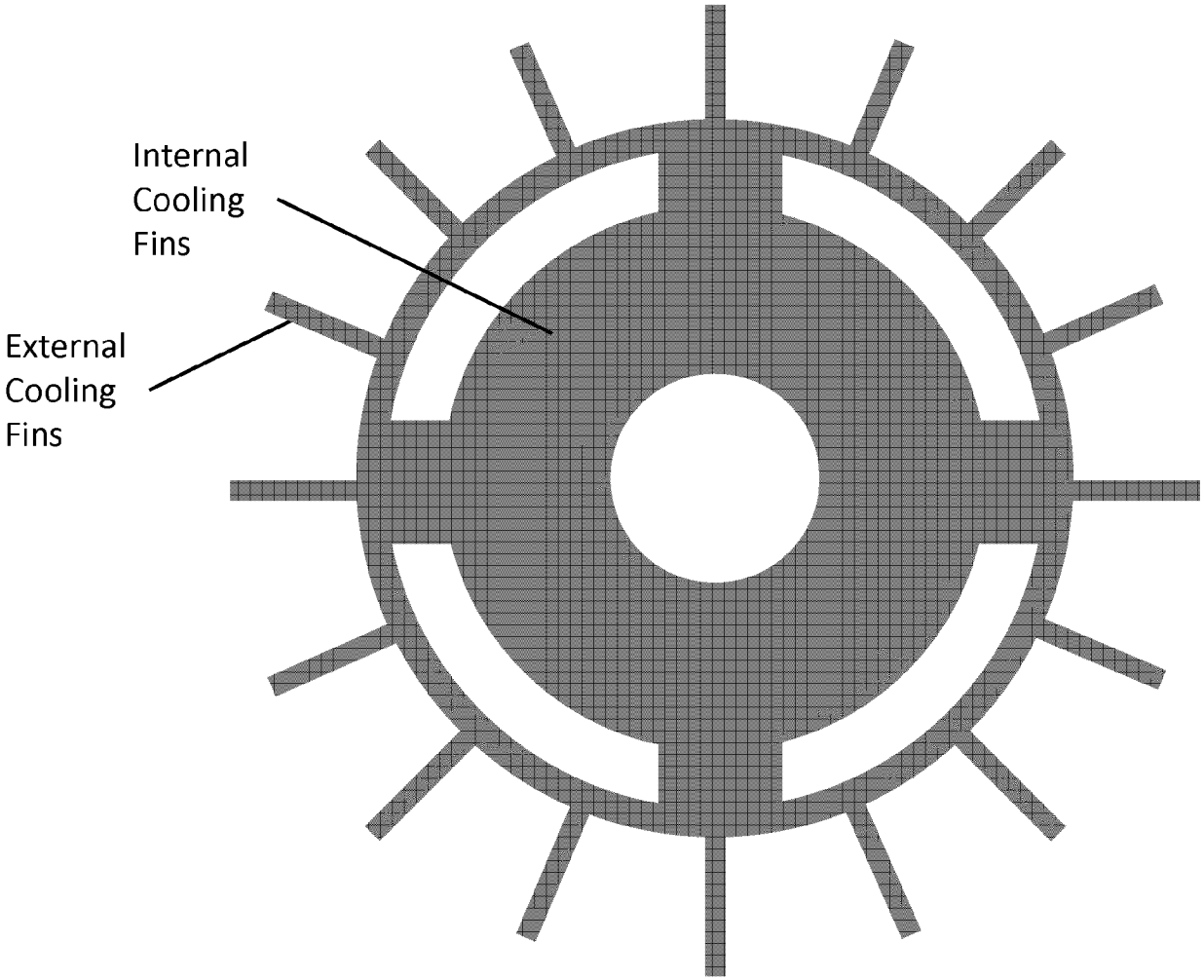
FIG. 7 is a diagram exemplifying the external cooling fins outside the device.

FIG. 7 displays more details on the external surface and cooling fins.

FIG. 8 lists data from using the method described herein using Athabasca bitumen as the source oil phase. The results show that 45% of the original volume is converted to the light oil phase and 55% is converted to the residual heavy oil phase.

FIG. 9 lists data from using the method described herein using Lloydminster heavy oil as the source oil phase. The results show that 55% of the original volume is converted to the light oil phase and 45% is converted to the residual heavy oil phase.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing. Citation of references herein is not an admission that such references are prior art to the present invention. Any priority document(s) and all publications, including but not limited to patents and patent applications, cited in this specification are incorporated herein by reference as if each individual publication were specifically and individually indicated to be incorporated by reference herein and as though fully set forth herein. The invention includes all embodiments and variations substantially as hereinbefore described and with reference to the examples and drawings.

What is claimed is:

1. A method of treating a source oil phase comprising a heavy oil, a bitumen, a mixture of heavy oil and bitumen, or a mixture of solvent and heavy oil or bitumen or both, the method comprising:

introducing the source oil phase to a heated lower section within a housing defining a device having an interior space and an exterior surface, to provide an interior source oil phase within the device;

heating the interior source oil phase so as to thermally separate a light oil phase component from the heated liquid interior source oil phase, to provide a vaporized light oil phase rising within an upper section of the interior space of the device;

condensing the vaporized light oil phase within the device on one or more internal cooling fins housed within the upper section of the device, to provide a condensed light oil phase liquid, wherein the internal cooling fins are angled so as to direct the condensed light oil phase liquid downwardly to a light end collection system disposed within the upper section of the device below the cooling fins and above the heated lower section;

injecting a cooling inert gas into a top portion of the device so as to cool the upper section of the device and so as to drive the condensed light oil phase liquid through the light end collection system and out of the device, to provide a light oil phase product; and, collecting a residual heavy oil phase from the lower section of the device.

2. The method of claim 1 where heating of the interior source oil is provided by one or more of electrical resistance heating, induction heating, heat tracing, or hot fluid heating either within a pipe disposed in the interior source oil phase or directly into the interior source oil phase.

3. The method of claim 1 where the temperature of the heated interior source oil is between about 280 and 600° C.

4. The method of claim 1, wherein heating the interior source oil comprises thermally cracking the interior source oil so as to generate an additional fraction of vaporized light oil.

5. The method of claim 1, wherein the interior space of the upper section of the device is maintained at a temperature between about 20° C. and 200° C.

6. The method of claim 1, where the internal cooling fins are cooled through heat conduction or by a cool fluid injection within the fins.

7. The method of claim 1, wherein the internal cooling fins are frusto-conically angled so as to direct the condensed light oil phase within the device towards the circumferential periphery of the upper section of the device.

8. The method of claim 7, wherein the light end collection system is disposed along the circumferential periphery of the interior space of the device.

9. The method of claim 1, further comprising cooling the exterior surface of the device.

10. The method of claim 1, where the cooling inert gas is selected from the group consisting of nitrogen, carbon monoxide, carbon dioxide, methane, ethane, propane, hydrogen, or combustion flue gas.

11. A device adapted for treating a source oil phase comprising a heavy oil, a bitumen, a mixture of heavy oil and bitumen, or a mixture of solvent and heavy oil or bitumen or both, the device comprising:

a source oil phase inlet into a heated lower section within a housing defining the device as having an interior space and an exterior surface, the heated lower section providing a reservoir for an interior source oil phase within the device;

a heater disposed to heat the interior source oil phase so as to thermally separate a light oil phase component from the heated interior source oil phase, to provide a vaporized light oil phase rising within an upper section of the interior space of the device;

internal cooling fins housed within the upper section of the device and adapted for condensing the vaporized light oil phase within the device on the internal cooling fins, so as to provide a condensed light oil phase liquid, wherein the internal cooling fins are angled so as to direct the condensed light oil phase liquid downwardly to a light end collection system disposed within the upper section of the device below the cooling fins and above the heated lower section;

a cooling inert gas inlet in a top portion of the device, positioned so as to permit an injected cooling inert gas to cool the upper section of the device and to drive the condensed light oil phase liquid through the light end collection system and out of the device, to provide a light oil phase product; and, a port for collecting a residual heavy oil phase from the lower section of the device.

12. The device of claim 11 where the heater for heating of the interior source oil is one or more of an electrical resistance heater, an induction heater, a heat tracing, or a hot fluid heater.

13. The device of claim 11, where the heater is adapted to provide a temperature of the heated interior source oil of between about 280 and 600° C.

14. The device of claim 11, wherein the heater is adapted to heat the interior source oil so as to thermally crack the interior source oil and thereby generate an additional fraction of vaporized light oil.

15. The device of claim 11, wherein the combined operation of the heater and the injected cooling inert gas is so as to provide a temperature within the interior space of the upper section of the device of between about 20° C. and 200° C.

16. The device of claim 11, where the internal cooling fins are cooled by a cool fluid injection within the fins.

17. The device of claim 11, wherein the internal cooling fins are frusto-conically angled so as to direct the condensed light oil phase within the device towards the circumferential periphery of the upper section of the device.

18. The device of claim 17, wherein the light end collection system is disposed along the circumferential periphery of the interior space of the device.

19. The device of claim 11, further comprising a cooling system disposed for cooling the exterior surface of the device.

20. The device of claim 11 where the cooling inert gas is selected from the group consisting of nitrogen, carbon monoxide, carbon dioxide, methane, ethane, propane, hydrogen, or combustion flue gas.

* * * * *